US005782482A

United States Patent [19]

Andrus et al.

[11] Patent Number: 5,782,482

[45] Date of Patent: Jul. 21, 1998

[54] SNOWBOARD AND METHOD OF CONSTRUCTION

[75] Inventors: Cameron Whitley Andrus, Vashon; Luke James Edgar, Seattle, both of Wash.

[73] Assignee: K-2 Corporation, Vashon, Wash.

[21] Appl. No.: 594,286

[22] Filed: Jan. 30, 1996

[51] Int. Cl.[6] ..... A63C 5/07

[52] U.S. Cl. ..... 280/602; 280/610; 280/14.2

[58] Field of Search ..... 280/14.2, 602, 280/607, 610, 617, 636

[56] References Cited

U.S. PATENT DOCUMENTS

| | | | |
|---|---|---|---|
| 2,384,729 | 9/1945 | Darby . | |
| 2,395,650 | 2/1946 | Allen . | |
| 2,526,137 | 10/1950 | Hunt . | |
| 3,722,901 | 3/1973 | Koike . | |
| 3,917,299 | 11/1975 | Anderson . | |
| 4,349,212 | 9/1982 | Svoboda . | |
| 5,016,901 | 5/1991 | Mayr . | |
| 5,096,217 | 3/1992 | Hunter | 280/14.2 X |
| 5,197,752 | 3/1993 | Engelbert et al. . | |
| 5,221,105 | 6/1993 | Mayr et al. . | |
| 5,320,378 | 6/1994 | Wiig . | |
| 5,401,041 | 3/1995 | Jespersen . | |
| 5,419,665 | 5/1995 | Adams et al. . | |
| 5,447,322 | 9/1995 | Masson et al. | 280/610 X |
| 5,498,016 | 3/1996 | Jodelet | 280/610 X |
| 5,514,018 | 5/1996 | Hara | 280/14.2 X |
| 5,573,264 | 11/1996 | Deville et al. | 280/602 |
| 5,609,351 | 3/1997 | Vermillion | 280/14.2 X |

FOREIGN PATENT DOCUMENTS

| | | |
|---|---|---|
| 0 553 417 A1 | 8/1993 | European Pat. Off. . |
| 0 622 096 A1 | 11/1994 | European Pat. Off. . |
| 1.282.053 | 12/1961 | France . |
| 2 692 158 | 12/1993 | France . |
| 0.620.028 A1 | 4/1994 | France . |
| 2 696 354 | 4/1994 | France . |
| 2 703 257 | 10/1994 | France . |
| 2 729 086 | 7/1996 | France . |
| 2 731 159 | 9/1996 | France . |
| 1 923 367 | 11/1970 | Germany . |
| 29 13 250 | 10/1980 | Germany . |

*Primary Examiner*—Brian L. Johnson
*Assistant Examiner*—Michael Mar
*Attorney, Agent, or Firm*—Christensen O'Connor Johnson & Kindness PLLC

[57] ABSTRACT

A snowboard having torsional reinforcement elements along portions of the board is provided. The snowboard includes a core, an upper structural layer disposed above the core, a top layer, two groups of binding fasteners, and torsional reinforcement elements in the forward and rearward portions of the board. The top layer is disposed above the upper structural layer. The fasteners are secured through the upper structural layer within the core. The fasteners are adapted for securing a binding to the snowboard generally along the longitudinal axis of the snowboard. The fasteners include forward fasteners for securing a forward binding and rearward fasteners for securing a rearward binding. A first torsional reinforcement element extends around the rearward fasteners along the longitudinal center axis of the snowboard above the core. The rearward reinforcement element includes a right leg extending from the rearward end of the fasteners toward the right heel contact point of the snowboard. A left leg is also provided that extends from the rearward end of the fasteners toward the left heel contact point of the snowboard. Likewise, the forward torsional reinforcement element includes a right leg and a left leg extending to the right shovel contact point and left shovel contact point, respectively. Thus, a forward fork and a rearward fork are provided, extending around the binding fasteners, and forking out to the heel and shovel contact points. A method of constructing the snowboard as described above is also provided.

32 Claims, 2 Drawing Sheets

SNOWBOARD AND METHOD OF CONSTRUCTION

FIELD OF THE INVENTION

This invention relates to snowboards and methods of constructing snowboards and, more particularly, to a torsionally reinforced snowboard.

BACKGROUND OF THE INVENTION

Most snowboards have several features in common, such as a longitudinal center axis, at least one tip, sidecut on both sides, and binding mounts for both feet. However, as with skis, manufacturers construct different types of snowboards for different snowboarding activities. Freestyle boards tend to be short and have upturned tips and tails. Cruising boards for carving on groomed runs tend to be long and stiff and include some damping to maintain edge hold. Backcountry powder boards are wide and long and may have binding fasteners (i.e., inserts) shifted rearwardly. All-around boards for both freestyle and freeriding fall somewhere in between these features.

Jumping is one activity particularly popular with freestyle riders. Launching into the air may be accomplished on a mound of snow, from the edge or side of a snowboard half-pipe, off of ledge or drop off, off other structures, or anywhere else imaginable. In order to use the board to jump higher, experienced riders will often load the shovel or heel of the board just prior to take off. This maneuver helps to spring the rider further up, similar to a diving board (except that the board is attached to the jumper's feet). Snowboards may be stiffly constructed to provide more launch power. However, freestyle boards are typically short and a stiff, short board will not ride with quiet control and speed on hardpack surfaces. Furthermore, snowboarders typically hit jumps at an angle (not straight-on). The rider must hold an edge bite in the last and most critical ten feet of the approach, especially when loading the tip or tail. Therefore, torsional rigidity and control from the bindings to the edge contact points may be even more important. Landing from a jump also is also preferably controlled, smooth, and soft.

The snowboard of the present invention was developed to provide additional torsional strength between the bindings and the snowboard edge contact points for improved jumping. The board maintains good midflex and carving ability as well as superior damping even with short board lengths. Increased edge stability and control and smoother, more cushioned landings from jumps also result from the snowboard construction. Thus, a snowboard is provided that improves performance in freestyle jumps and stunts while maintaining excellent freeriding characteristics.

SUMMARY OF THE INVENTION

The present invention provides significant advantages over the prior art snowboard constructions and methods of construction with a snowboard that includes a longitudinal axis, a shovel, a heel, and edges. The snowboard also includes a core, an upper structural layer, a top layer, a plurality of fasteners, and a first torsional reinforcement element. The upper structural layer is disposed above the core. The top layer is disposed above the upper structural layer. The fasteners are secured through and beneath the upper structural layer within the core. The fasteners are adapted for securing a binding on top of the snowboard generally along its longitudinal axis. The fasteners include forward fasteners for securing a forward binding and rearward fasteners for securing a rearward binding. The first torsional reinforcement element extends around the fasteners, along the longitudinal center axis of the snowboard above the core. The reinforcement element includes a first leg extending from the fasteners toward one of the shovel and heel of the snowboard and toward the edge of the snowboard.

In the preferred embodiment of the invention, the portion of the first reinforcement element adjacent the fasteners is a first strip of material. First and second legs extend from the end of the first strip. The second leg extends in a direction generally away from the first leg toward the shovel or heel of the snowboard and toward the edge of the snowboard.

The snowboard includes shovel and heel contact points at the edges of the snowboard. The first and second legs each extend generally toward opposite contact points of one of the shovel and heel of the snowboard.

As another preferred aspect, the reinforcement element is constructed of a carbon fiber material impregnated with a thermoset resin.

Another aspect of the preferred embodiment includes a second reinforcement element. In this embodiment, the first reinforcement element is disposed within a rearward portion of the snowboard. The second reinforcement element is disposed within a forward portion of the snowboard. The second reinforcement element includes a strip of material extending around the forward fasteners with legs extending forwardly from the forward end of the strip toward the shovel contact points. The legs of the first reinforcement element extend toward the heel contact points. Preferably, the first and second reinforcement elements are separated by a middle portion of the board.

The reinforcement elements are disposed between the top of the snowboard and the snowboard core. Preferably, the reinforcement elements are bonded to the upper structural layer of the snowboard. The reinforcement elements are laid up with wet resin along with the wet upper structural layer such that when the reinforcement elements and upper structural layer cure, the two are bonded together with a thermoset resin. The portion of the reinforcement elements adjacent the fasteners is molded flat with the top of the snowboard, providing a region for attachment of the bindings. However, the legs are preferably molded into the top of the snowboard to project slightly upward, such that a forked shape on top of the board is visible.

A method of constructing a snowboard with the reinforcement elements is also provided. The method includes forming a reinforcing element including a strip, a right leg extending in one direction from the end of the strip, and a left leg extending away from the right leg from the same end of the strip. The reinforcement element is then placed between the top of the snowboard and the core of the snowboard with the strip being adjacent the binding fasteners. The right leg extends toward the right edge of the snowboard and the left leg extends toward the left edge. The preferred method further includes placing a resin-wetted upper structural layer adjacent the reinforcing element before the reinforcing element is placed between the top and the core. The reinforcing element is constructed of a fiber material and impregnated with a wet resin when placed with the upper structural layer such that the structural fiber layer and the reinforcing element are bonded together between the core and the top of the snowboard when the resin is cured.

The snowboard construction of the invention provides several advantages over prior snowboards. One particular advantage of the design is to enable a snowboard rider to jump higher and with more control whether jumping within a snowboard half pipe, quarter pipe or any other kind of jump or launch site. The design enables the rider to hit the takeoffs with more control and accuracy, maneuver the board easier and with more control in the air and hit the landings with more consistency and cushion. Each of the strips combined with the respective right and left legs on both the front and rear of the board, forms a structural fork in the board. Each fork extends from the binding fasteners so that forces are transmitted from the snowboard boot through the binding and into the forked reinforcement element. The fork transmits the forces from the binding zone to the edge of the snowboard. Thus, the torsional strength of the board from the binding to the general area of the contact points of the board is increased. The contact points of the board are located at the shovel and heel where the board first touches the snow when laid on edge. Thus, the reinforcement elements help transmit the energy from the rider's feet in the binding areas diagonally out to the edges. Since snowboarders typically hit jumps at an angle (not straight-on), the torsional reinforcement elements help to hold the edge bite in the last and most critical 10 feet of the approach, and especially at that last instant when the rider can "snap" off the tail by loading up the fork like a diving board. The rider springs higher into the air. The torsional reinforcement elements also add damping to the tip and tail areas of the board to make for a smoother, more stable ride. Riders who normally use a longer board have been able to decrease length for easier jumps and stunts and still have as much or more control even at high speeds. The reinforcement elements do not extend over the mid-section of the snowboard between the binding fastening zones. Thus, the board is allowed to flex well in this central region such that the board remains soft enough to provide excellent carving and soft jump landings.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
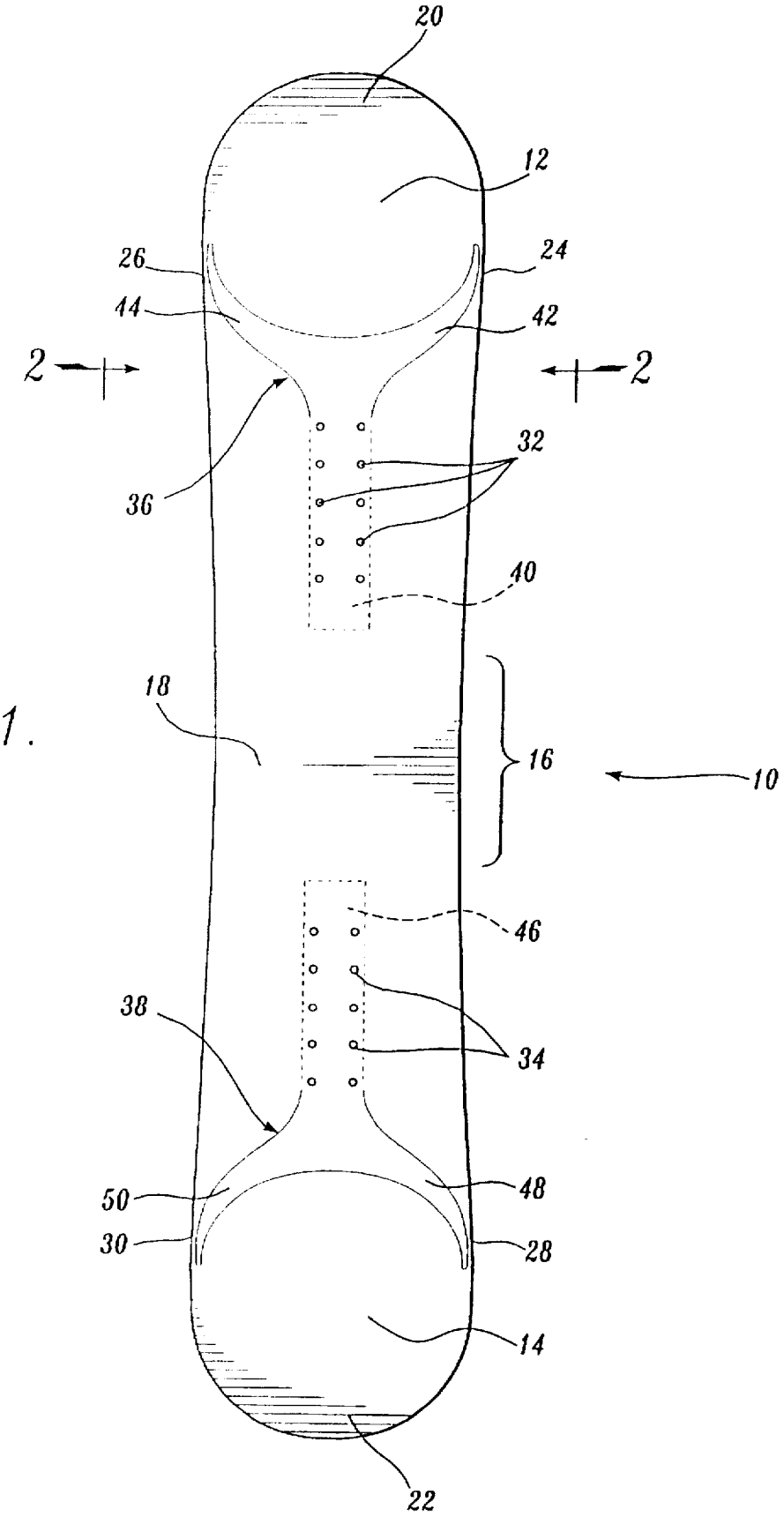
FIG. 1 is a plan view of a snowboard incorporating the forks of the present invention with the portions of the forks that project upwardly from the top of the board shown in solid lines and those that are integrated flat with the top of the board shown in phantom lines.

Referring to FIG. 1, a snowboard 10 is provided that includes a shovel 12 at the front of the board, a heel 14 at the rearward end of the board, and a midportion 16 between the two. A waist 18 is located at the narrowest portion of the board generally in the middle of midportion 16. A tip 20 extends upwardly at the front of the board at the forward end of shovel 12. A tail 22 extends upwardly at the rearward end of heel 14.

The locations on the sides of snowboard 10 with the greatest width are on the right and left sides of shovel 12 and heel 14 and are termed the contact points. A right shovel contact point 24 is on the right side of shovel 12 and a left shovel contact point 26 is on the left side of shovel 12. Likewise, a right heel contact point 28 and left heel contact point 30 are situated at the edges of heel 14. These contact points are the first points to contact the snow surface when snowboard 10 is put on edge due to the side camber of snowboard 10.

Forward inserts 32 and rearward inserts 34 are also disposed within the body of snowboard 10 for use in securing snowboard bindings thereto. Forward inserts 32 preferably include between 8 and 12 inserts. Inserts 32 and 34 are placed within the core of the snowboard and project up toward the top surface with an opening in the top surface and a threaded bore in the inserts themselves for attachment of screw fasteners thereto from the bindings. Two columns of five inserts each are shown in the preferred embodiment of FIG. 1. However, other configurations may alternatively be used. The rearwardmost of forward inserts 32 is forward of midportion 16 of snowboard 10. The forwardmost of rearward inserts 34 is rearward of midportion 16. Forward and rearward inserts 32 and 34 are positioned for optimum placement and adjustability of snowboard bindings, which are to be secured thereto.

The basic configuration of snowboard 10, having been discussed above the improvement thereon will now be discussed. As seen in FIG. 1, two forks, a forward fork 36, and a rearward fork 38, are provided within snowboard 10. As explained in more detail below, each of these forks transmits torsional forces from the bindings mounted to inserts 32 and 34 to the edges of snowboard 10 adjacent the contact points. Thus, in the region between the forward snowboard binding (the region of inserts 32) and shovel contact points 24 and 26, the torsional rigidity of snowboard 10 is increased such that the energy of the user is efficiently transmitted over this distance to the edge. Likewise, between the rearward binding and heel contact points 28 and 30 the torsional stiffness is increased. However, the board remains flexible for proper carving and control since the remainder of the board does not include the extra reinforcement material. For example, midportion 16 does not include, in the preferred embodiment, any portion of forks 36, 38.

Forward fork 36 is constructed of a forward strip 40 extending around forward inserts 32. Forward strip 40 begins adjacent the rearwardmost of forward inserts 32. Forward strip 40 extends forwardly with a width slightly greater than the columns of forward inserts 32. Forward strip 40 extends toward tip 20 along the longitudinal axis of snowboard 10 to a position forward of forward inserts 32. At that point, forward fork 36 splits into right and left directions to form a right forward leg 42 and left forward leg 44. In the preferred embodiment, legs 42 and 44 extend transversely to the longitudinal axis of snowboard 10 as they begin to diverge from forward strip 40. As legs 42 and 44 extend outwardly they curve forwardly such that they extend adjacent right and left shovel contact points 24 and 26. As legs 42 and 44 extend outwardly and forwardly they also taper down in width until at the contact points they are less than one-fourth as wide as forward strip 40.

Rearward fork 38 is constructed in a similar manner to forward fork 36 with a rearward strip 46 extending along and surrounding rearward inserts 34, a right rearward leg 48, and left rearward leg 50. Thus, rearward fork 38 is substantially a mirror image of forward fork 36. Right and left rearward legs 48 and 50 extend from the rearward end of rearward strip 46 to right and left heel contact points 28 and 30.

Note that other overall configurations could be used to accomplish the same transfer of forces from the binding fastening zone to the edges of the snowboard. For example, a T-shape or a triangular shape could be used instead of a fork shape. The basic construction of having a reinforcement element around the binding area and extending toward the edges of the snowboard, preferably toward the contact points, are encompassed by the present invention.

Figure 2:
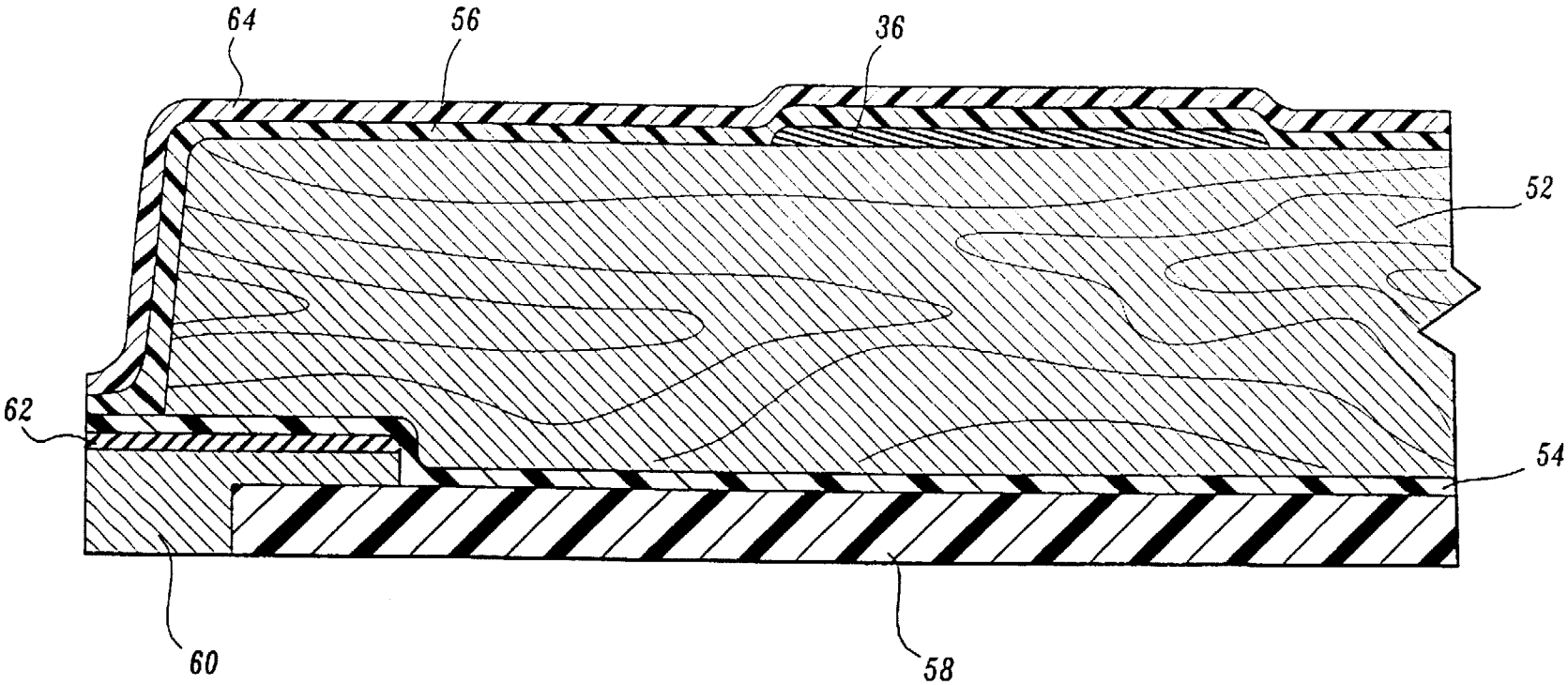
FIG. 2 is a cross-sectional view showing the preferred positioning of the fork within the body of the snowboard.

The preferred internal construction of forks 36 and 38 of snowboard 10 are illustrated in FIG. 2. Snowboard 10 includes a core 52 preferably constructed of vertically laminated wood. A base structural layer 54 underlies core 52 and provides structural rigidity to snowboard 10 as well as structural support for the bottom of snowboard 10. A top structural layer 56 surrounds the top and preferably the sides of core 52. Top structural layer 56 and base structural layer 54 are preferably made in a conventional fashion with thermoset resin-impregnated fiberglass material.

A base 58 is secured beneath base structural layer 54 and provides the riding surface of snowboard 10. Base 58 is preferably constructed of polyethylene, either sintered or extruded. Edges 60 are provided on the lateral sides of snowboard 10 adjacent base 58 and are secured thereto with base structural layer 54 in a conventional manner. Edges 60 may also include rubber layer 62 to provide damping and some shock absorption to edges 60. Rubber layer 62 directly overlies edge 60. A top layer 64 extends over the top and sides of core 52 and top structural layer 56 to protect top structural layer 56 and to provide snowboard graphics. Top layer 64 is preferably constructed of a polyurethane material.

Forward and rearward forks 36 and 38 are preferably positioned on top of core 52 beneath top structural layer 56. FIG. 2 illustrates forward fork 36. Alternatively, forward fork 36 (or rearward fork 38) could be placed between top layer 64 and top structural layer 56. In the area adjacent forward and rearward inserts 32 and 34, forward and rearward strips 40 and 46 are flattened out with top structural layer 56 such that they do not cause an upward projection of top layer 64 on snowboard 10. This is preferred for fastening any snowboard bindings onto inserts 32 and 34 adjacent a flat top surface of snowboard 10. In other words, the fiber layers of structural layer 56 and forks 36 and 38 are compressed together in the molding tool such that the cured shape is flat in this region. In contrast, the molding tool allows legs 42, 44, 48, and 50 to project upwardly forward of forward strip 40 and rearward of rearward strip 46 such that the top of snowboard 10 bulges slightly upwardly in the region of legs 42, 44, 48, and 50. This bulging is illustrated in FIG. 2.

Forks 36 and 38 are preferably constructed of a carbon and glass fiber composite material impregnated with a thermosetting resin. However, alternate constructions could be used with different materials such as metals or other composites. Also, the positioning of fork 36 could be altered. For example, fork 36 may be placed on top of top layer 64, between top layer 64 and top structural layer 56, within core 52, or even between core 52 and base structural layer 54. The principle focus of the fork (or other torsion shape) is to transmit the torsional forces from the binding attachment at the inserts to the edge of the snowboard, preferably to the contact point since this is the location at which much of the contact force is provided when jumping. Alternatively, forward fork 36 and rearward fork 38 could be interconnected throughout mid-portion 16, possibly with a reduced material cross section. However, in the preferred embodiment, mid-portion 16 does not include coverage by either of forks 36 or 38. This allows snowboard 10 to maintain an adequate flex pattern to enable proper curvature of snowboard 10 for carving turns. Also note that the width of forward strip 40 and rearward strip 46 is not excessive so that extreme longitudinal stiffness is not created.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A snowboard having a longitudinal axis, a shovel portion, a heel portion, and first and second longitudinal edges, the snowboard comprising:

(a) a core;

(b) an upper structural layer disposed above said core:

(c) a top layer disposed above said upper structural layer:

(d) a plurality of fasteners secured through said upper structural layer within said core, said fasteners adapted for securing a first and a second binding on top of the snowboard generally along the longitudinal axis of the snowboard, said fasteners including forward fasteners for securing a forward binding and rearward fasteners for securing a rearward binding; and (e) a first and a second torsional reinforcement element for reinforcing the snowboard shovel portion and heel portion, respectively, each torsional reinforcement element including an inner elongate leg portion extending below a respective binding along the longitudinal center axis of the snowboard above said core, each said reinforcement element further including an outer portion which includes a transverse head portion having a center section with a transverse axis extending primarily laterally across a major portion of a width of the snowboard and toward the first and second edges of the snowboard, thereby forming a T-shaped portion of the reinforcing element.

2. The snowboard of claim 1, wherein at least one reinforcement element includes first and second end portions extending substantially longitudinally from left and right sides of the transverse head portion.

3. The snowboard of claim 1, wherein the snowboard includes shovel and heel contact points at the edges of the snowboard, wherein said transverse head portion extends generally toward opposite contact points of one of the shovel and heel portions of the snowboard.

4. The snowboard of claim 3, wherein said reinforcement element comprises carbon fiber impregnated with a thermoset resin.

5. The snowboard of claim 1, wherein said first and second reinforcement elements are separated, the elements not extending over a middle portion of the snowboard.

6. The snowboard of claim 1, wherein said first reinforcement element includes two legs each extending from an end thereof, toward one of the snowboard contact points.

7. The snowboard of claim 6, wherein said reinforcement element comprises carbon fiber impregnated with a thermoset resin.

8. A snowboard having a longitudinal axis, a forward portion, a rearward portion, a shovel within the forward portion, a heel within the rearward portion, and right and left edges, the snowboard comprising:

(a) a top layer;

(b) a base below said top layer;

(c) a core positioned between said top layer and base;

(d) a plurality of fasteners secured between said top layer and said base, said fasteners adapted for securing a pair of snowboard bindings to the snowboard generally along the longitudinal axis of the snowboard, said fasteners being generally in two groups, a forward group and a rearward group; and (e) a first reinforcement element extending adjacent at least some of said fasteners in one of the forward and rearward positions of the snowboard, said reinforcement element including an inner elongate leg portion extending below a respective binding along the longitudinal center axis of the snowboard, said reinforcement element further including an outer portion which includes at least one transverse first leg having a center section with a transverse axis extending primarily laterally from the inner elongate leg portion across a major portion of the way toward a respective edge of the snowboard, thereby defining at least one side of a T-shaped portion of the reinforcing element.

9. The snowboard of claim 8, wherein the reinforcement element includes a first end portion extending substantially longitudinally from the transverse leg portion along the respective edge.

10. The snowboard of claim 8, wherein said first leg extends toward one of the shovel and heel of the snowboard.

11. The snowboard of claim 8, further comprising a second reinforcement element adjacent said forward group of said fasteners, said first reinforcement element being adjacent said rearward group.

12. The snowboard of claim 11, wherein said reinforcement elements are separated by a middle portion of said snowboard.

13. The snowboard of claim 11, wherein the snowboard includes four contact points;

right and left heel contact points and right and left shovel contact points, and wherein said first reinforcement element includes two legs, a right leg extending generally toward the right heel contact point and a left leg extending generally toward the left heel contact point, and wherein said second reinforcement element includes two legs, a right leg extending generally toward the right shovel contact point, and a left leg extending generally toward the left shovel contact point.

14. The snowboard of claim 13, wherein said first and second reinforcement elements are disposed between said top layer and said base.

15. The snowboard of claim 14, wherein the snowboard includes a core between said top layer and said base, the snowboard also including an upper structural layer disposed between said core and said top layer, and wherein said reinforcement elements are disposed between said top layer and said core, said reinforcement elements being bonded to said upper structural layer.

16. The snowboard of claim 15, wherein the portion of said top layer of the snowboard overlying said legs of said reinforcement elements projects upwardly from the remainder of said top layer.

17. The snowboard of claim 16, wherein the portion of said top layer of the snowboard overlying the portion of said reinforcement elements adjacent said fasteners is generally co-planar with the adjacent portions of said top layer.

18. The snowboard of claim 8, wherein said first reinforcement element includes a second leg extending toward the left edge of the snowboard and toward one of the shovel and heel of the snowboard, the first leg extending toward the right edge and the same one of the shovel and heel as the second leg.

19. The snowboard of claim 18, further comprising a second reinforcement element extending along the forward portion of the snowboard adjacent said forward group of fasteners, said first reinforcement element extending along the rearward portion of the snowboard.

20. The snowboard of claim 19, wherein said first and second reinforcement elements are separated by a middle portion of the snowboard.

21. The snowboard of claim 8, further comprising a second reinforcement element extending along the forward portion of the snowboard adjacent said forward group of fasteners, said first reinforcement element extending along the rearward portion of the snowboard.

22. The snowboard of claim 21, wherein said reinforcement elements comprise carbon fiber impregnated with a resin.

23. The snowboard of claim 21, wherein said first and second reinforcement elements are separated by a middle portion of the snowboard.

24. The snowboard of claim 23, wherein said top layer of the snowboard is flat over an area above said fasteners.

25. The snowboard of claim 24, wherein the snowboard includes right and left edge contact points at the shovel and heel, and wherein said first leg extends toward one of said contact points.

26. The snowboard of claim 8, wherein the snowboard includes right and left edge contact points at the shovel and heel, and wherein said first leg extends toward one of said contact points.

27. The snowboard of claim 26, wherein said reinforcement element further includes a second leg extending to one of said contact points along the left edge of the snowboard, said first leg extending to one of said contact points along the right edge of the snowboard.

28. The snowboard of claim 27, further comprising a second reinforcement element adjacent said forward group of fasteners, said first reinforcement element being adjacent said rearward group of fasteners.

29. The snowboard of claim 28, wherein said reinforcement elements are separated by a middle portion of the snowboard.

30. The snowboard of claim 8, wherein said top layer includes an upper structural layer formed of a fiber material and wherein said reinforcement element comprises a fiber material bonded to said upper structural layer with a resin.

31. A method of constructing a snowboard having a top layer, a base, a core between the top layer and the base, a plurality or binding fasteners within the core between the top and the base for securing a pair of bindings to the snowboard, and right and left edges on the sides of the base, the method comprising:

(a) forming a reinforcing element into an elongate strip having an inner and an outer end, a right leg extending in one direction from the outer end of the strip, and a left leg extending from the outer end of the strip in an opposite direction from the right leg, the right and left leg cooperatively defining an outer portion including a transverse head portion having a center section with a transverse axis extending primarily laterally relative to the strip and sufficient to span a major portion of a width of the base between the right and left edges, thereby forming a T-shaped portion of the reinforcing element; and (b) placing the reinforcing element between the top layer of the snowboard and the core of the snowboard, with the elongate strip extending along a longitudinal axis of the snowboard and positioned below a respective binding, the right leg extending toward the right edge of the snowboard and the left leg extending toward the left edge.

32. The method of claim 31, further comprising placing a resin-wetted upper structural fiber layer adjacent the reinforcing element before the reinforcing element is placed between the top layer and the core, the reinforcing element being constructed of a fiber material and being impregnated with a wet resin when placed with the wet upper structural layer such that the structural fiber layer and the reinforcement element are bonded together between the core and the top layer of the snowboard when the resin is cured.

* * * * *

UNITED STATES PATENT AND TRADEMARK OFFICE

CERTIFICATE OF CORRECTION

PATENT NO. : 5,782,482

DATED : July 21, 1998

INVENTOR(S) : C.W. Andrus et al.

It is certified that error appears in the above-identified patent and that said Letters Patent is hereby corrected as shown below:

| COLUMN | LINE | |
|---|---|---|
| 8 (Claim 31, | 48 line 3) | "or" should read --of-- |

Signed and Sealed this

Third Day of November, 1998

*Attest:*

Bruce Lehman

BRUCE LEHMAN

*Attesting Officer*

*Commissioner of Patents and Trademarks*